US005600427A

United States Patent [19]

Watanabe et al.

[11] Patent Number: 5,600,427

[45] Date of Patent: Feb. 4, 1997

[54] PAPER DEHUMIDIFYING UNIT FOR IMAGE FORMING APPARATUS

[75] Inventors: Yoshiaki Watanabe; Takuji Miyazawa, both of Kanagawa, Japan

[73] Assignee: Fuji Xerox Co., Ltd., Tokyo, Japan

[21] Appl. No.: 325,932

[22] Filed: Oct. 19, 1994

[30] Foreign Application Priority Data

Oct. 21, 1993 [JP] Japan ..... 5-285627

[51] Int. Cl.[6] ..... G03G 15/00

[52] U.S. Cl. ..... 399/97; 399/44

[58] Field of Search ..... 219/216, 471, 219/388; 355/285, 289, 290, 308, 309, 215, 208, 311; 165/3; 236/44 C; 271/9.01, 145

[56] References Cited

U.S. PATENT DOCUMENTS

| | | | |
|---|---|---|---|
| 4,306,802 | 12/1981 | Kucera et al. | 219/216 X |
| 4,766,454 | 8/1988 | Larsen | 354/302 |
| 5,160,399 | 11/1992 | Ueda et al. | 156/359 |

FOREIGN PATENT DOCUMENTS

| | | |
|---|---|---|
| 56-72452 | 6/1981 | Japan . |
| 56-102552 | 8/1981 | Japan . |
| 61-69627 | 4/1986 | Japan . |
| 463080 | 3/1937 | United Kingdom . |
| 508609 | 7/1939 | United Kingdom . |

*Primary Examiner*—Thu A. Dang

*Attorney, Agent, or Firm*—Finnegan, Henderson, Farabow, Garrett & Dunner, L.L.P.

[57] ABSTRACT

Two lowermost heating members and one intermediate heating member are provided for a plurality of paper feeding trays disposed in the paper feeding portion of an image forming apparatus and the temperature in the whole paper feeding portion is controlled by supplying power to each of the heating members. The heating member is provided with a heat reflective plate and a heat insulating plate side by side to insulate the heat of a heating element. The heating member is placed close to the tray and the temperature in the whole paper feeding portion is controlled under a convection current of the heat emanated from the heating element in the paper feed. Moreover, a humidity sensor may be installed on the side or within the image forming apparatus to control the power supplied to each heating member.

17 Claims, 3 Drawing Sheets

PAPER DEHUMIDIFYING UNIT FOR IMAGE FORMING APPARATUS

BACKGROUND OF THE INVENTION

1. Field of the Invention

The present invention relates to a paper dehumidifying unit to be placed in a paper feeding device of an apparatus such as an electrophotographic copy machine. More particularly, the present invention relates to a paper dehumidifying unit for an image forming apparatus including heating means which is disposed between a plurality of paper feeding trays being placed in the paper feeding device or under the tray and performing the dehumidification of the copying paper under a convection current of heat in the paper feeding device by causing the heat emanated from the heating means not to be directly transmitted to copying paper.

2. Description of the Related Art

An image forming apparatus such as an electrophotographic copy machine includes a plurality of paper feeding trays disposed in the lower part of the body of the apparatus to make up a paper feeding device from which sheets of copying paper of any size can be fed out of those different in size and accommodated in the paper feeding trays installed therein. When the toner image formed on an image carrier such as a photosensitive drum is transferred onto copying paper in the image forming apparatus, the humidity contained in such copying paper has been known to greatly affect the transfer operation. When the moisture content of copying paper is high, for example, the transfer of such a toner image is not carried out in good condition and the problem is that copy quality is deteriorated as whites are generated in the image. When the moisture content of copying paper is locally high, moreover, the copying paper tends to wave and when it is heated while being passed through a fixing apparatus, the wavy condition of the copying paper lets such problems arise as making the copy look unattractive, causing jamming when it is conveyed through the paper conveying channel, inferior image transfer and so forth.

In order to solve the aforesaid problem attributed to the moisture content of copying paper, heating means are arranged for paper feeding trays or the like to regulate the humidity of copying paper. Unexamined Japanese Patent Publication No. Sho. 56-72452, for example, discloses an arrangement in which a heating means is provided at the rear end of paper feeding tray in the paper feeding direction so as to dehumidify not only copying paper thereby but also the interior of an image forming apparatus by circulating hot air therein. Moreover, Unexamined Japanese Utility Model Publication No. Sho. 56-102552 and Unexamined Japanese Patent Publication No. Sho. 61-69627 also disclose an arrangement, for example, in which heating means are placed above a paper feeding tray where copying paper is accommodated to exert heating action onto upper sheets of copying paper in the tray. When heating means are arranged above the tray, the copying paper fed by paper feed rollers or the like is dehumidified efficiently.

However, the heat emanating from the heating means is directly applied to copying paper when a dehumidifying unit of the sort mentioned in the above related art is employed and the side portion of copying paper containing much moisture is caused to wave in conspicuous curves accordingly. Therefore, there arises the problem of not solely hindering copying paper from being conveyed because of its wavy condition as noted previously but also causing trouble to the transfer of a toner image. When the moisture contained in copying paper is distributed unevenly, copying paper becomes rugged when it is directly heated and this also poses a problem in that good copying quality is not maintained because it is not allowed to contact the photosensitive drum uniformly.

SUMMARY OF THE INVENTION

An object of the present invention made to solve the foregoing problems characteristic of the related art dehumidifying means is to provide a paper dehumidifying unit for an image forming apparatus which is used for dehumidifying the whole surface of coping paper uniformly so as to prevent the paper from waving and so forth by providing a mechanism for dehumidifying the paper without directly heating it by controlling the temperature in the interior of a paper feed.

According to the present invention, a paper dehumidifying unit for an image forming apparatus having a paper feeding device containing a multi-stage paper feeding tray and allowing copying paper to be fed from any one of the trays, the paper dehumidifying unit includes heating member placed at least one of under a paper feeding tray and between the paper feeding trays disposed in the paper feeding device, for heating an inside of the paper feeding device, control device for controlling a heating action of the heating member and member for preventing the transmission of the heat emanated from the heating member directly to copying paper.

As described above, the member for preventing the heating member provided in the paper feeding device from directly heating the copying paper accommodated in the paper feeding trays allows the heat emanated from the heating members to heat the interior of the paper feeding device under a convention current of air.

BRIEF DESCRIPTION OF THE DRAWINGS

In the accompanying drawings.

DETAILED DESCRIPTION OF THE PREFERRED EMBODIMENTS

A detailed description of a paper dehumidifying unit for an image forming apparatus according to the present invention will be described referring with the accompanying drawings as follows. In an example of FIG. 1, a paper feeding portion 2 is placed in the lower part of the body of an image forming apparatus 1 such as an electrophotographic copy machine and a plurality of paper feeding trays 5 to 7 are contained in the paper feeding portion 2. As in the case of an ordinary electrophotographic copy machine, sheets of copying paper different in size are respectively stacked in each of the plurality of paper feeding trays disposed in the paper feeding portion 2 and copying paper of proper size is delivered to an image recording unit according to the information on the size of an original and the magnification/reduction ratio. In the paper feeding portion 2 thus constructed, tray guides 4 corresponding to the respective paper feeding trays are disposed so as to position the paper feeding trays and by fitting each paper feeding tray along the tray guides 4, it can properly be positioned relative to the paper feed. In the paper feeding portion 2, moreover, no plate members, for example, other than the guides installed on both side of each paper feeding tray are unnecessary and this provides a space large enough for the trays to be spaced apart properly in the vertical direction.

Figure 1:
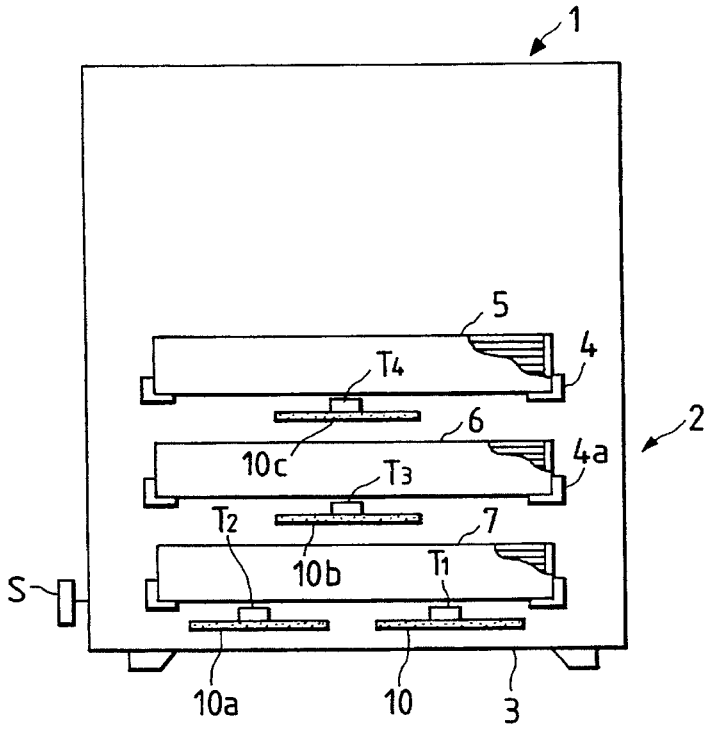
FIG. 1 is a block diagram illustrating a dehumidifying mechanism of the present invention.

In the image forming apparatus shown in FIG. 1, two heating members 10, 10*a* are disposed between the lowermost paper feeding tray 7 and a bottom frame 3 to warm the paper feeding portion 2 from the lower portion of the paper feeding portion 2. Further, heating members 10*b*, 10*c* are also disposed between the paper feeding trays 5, 6 and between the paper feeding trays 6, 7 respectively so as to provide a heating mechanism for the paper feed. Temperature control elements T1 to T4 are also disposed at the respective heating members in the paper feed portion to control the heating temperature. In addition, a humidity sensor S is installed outside the apparatus to input information as to the humidity of the open air so that the heating members may generate heat at temperatures corresponding to the atmospheric humidity. Consequently, the interior of the paper feed portion is kept at constant temperature or humidity under control. Incidentally, such a humidity sensor may be placed at any desired position in the paper feed portion to control the operation of the heating members according to the information gained from the sensor about humidity therein.

Figure 2:
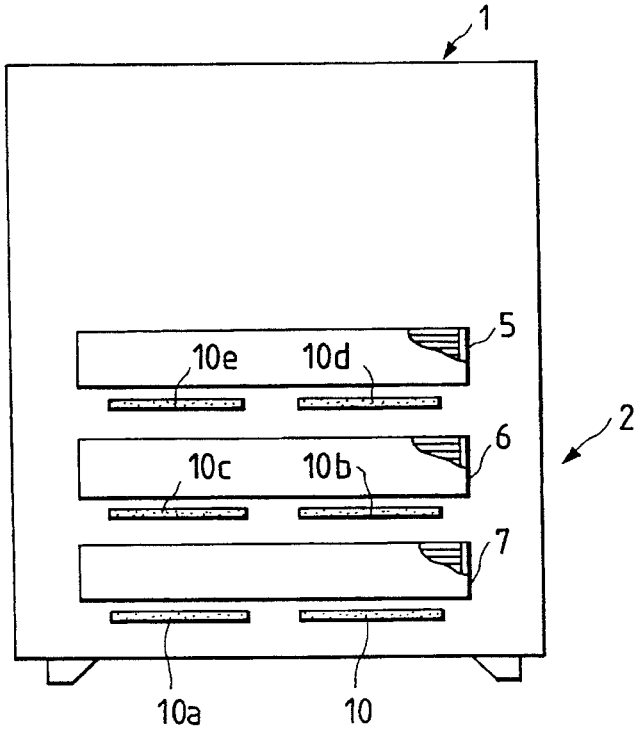
FIG. 2 is a block diagram illustrating another dehumidifying mechanism of the present invention.
Figure 3:
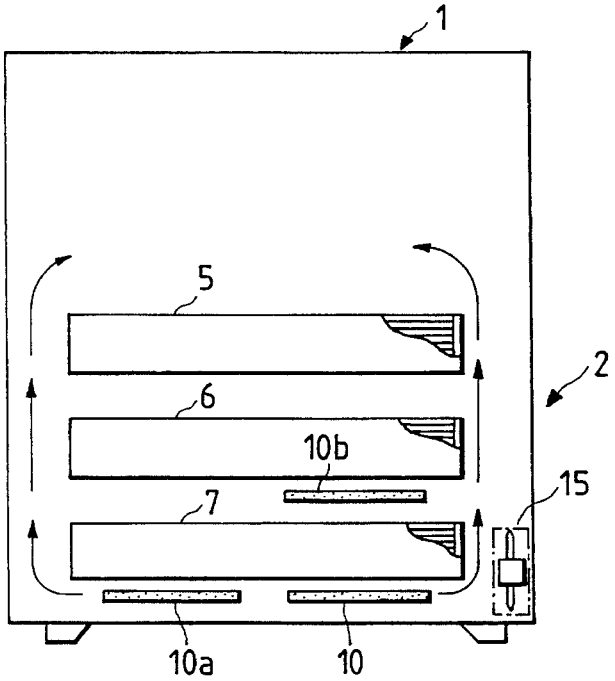
FIG. 3 is a block diagram illustrating still another dehumidifying mechanism of the present invention.

In an example of FIG. 2, paper feeding trays 5 to 7 disposed in a paper feed portion 2 are provided with pairs of heating members 10 to 10*e* to form unit for heating the copying paper placed in the paper feed portion. Also in the paper dehumidifying unit shown in FIG. 2, the same elements as those in FIG. 1 form a mechanism for controlling the respective heating members disposed in the paper feed portion. Additionally, in the case of an example of FIG. 3, two heating members 10, 10*a* are disposed under the lowermost paper feeding tray, whereas a heating member 10*b* is disposed under the middle paper feeding tray 6. In this case, information as to temperatures and humidity is input to a control device installed in the body of the apparatus to make up a mechanism for controlling the heating temperature with respect to each heating member. In the example of FIG. 3, the whole of heating unit is effectively utilized without installing any heating member under the uppermost paper feeding tray in consideration of the heat generated by the lower heating members intended to control the temperature in the whole paper feed.

In the paper dehumidifying unit shown in FIGS. 1 to 3, the heating members do not exert a heating action directly on the copying paper accommodated in the trays but perform the dehumidifying operation indirectly by controlling the atmospheric temperature in the paper feed portion as a whole. In other words, each of the heating members placed under the respective paper feeding trays is designed so that the heating element is not directly fitted to the frame of the tray and there is provided a member for preventing the heating element from directly transmitting its heat to copying paper or the frame of such a paper feeding tray by reference to heating members as shown in and after FIG. 5.

In the present invention, the moisture content of copying paper can be reduced by regulating the temperature in the apparatus. For example, as shown in FIG. 3, a fan 15 may be installed in the lower part of the paper feed portion so as to control the heating action therein. In addition, the control device is caused to output an instruction for driving the fan 15 on the basis of information deriving from detection device such as humidity and/or temperature sensors arranged in the paper feed portion so as to make dehumidifying action on the copying paper accommodated in the paper feed portion well effective by regulating the heating action exerted by the plurality of heating members according to the information on the temperature distribution in the apparatus. Moreover, large-capacity heating members and a fan may be arranged between the lowermost paper feeding tray and the bottom frame of the paper feed, whereas a plurality of sensors may be installed at desired positions in the paper feed portion according to the present invention, whereby a convection current of air in the apparatus is allowed to make the action of dehumidifying copying paper demonstrate its effect.

Figure 4:
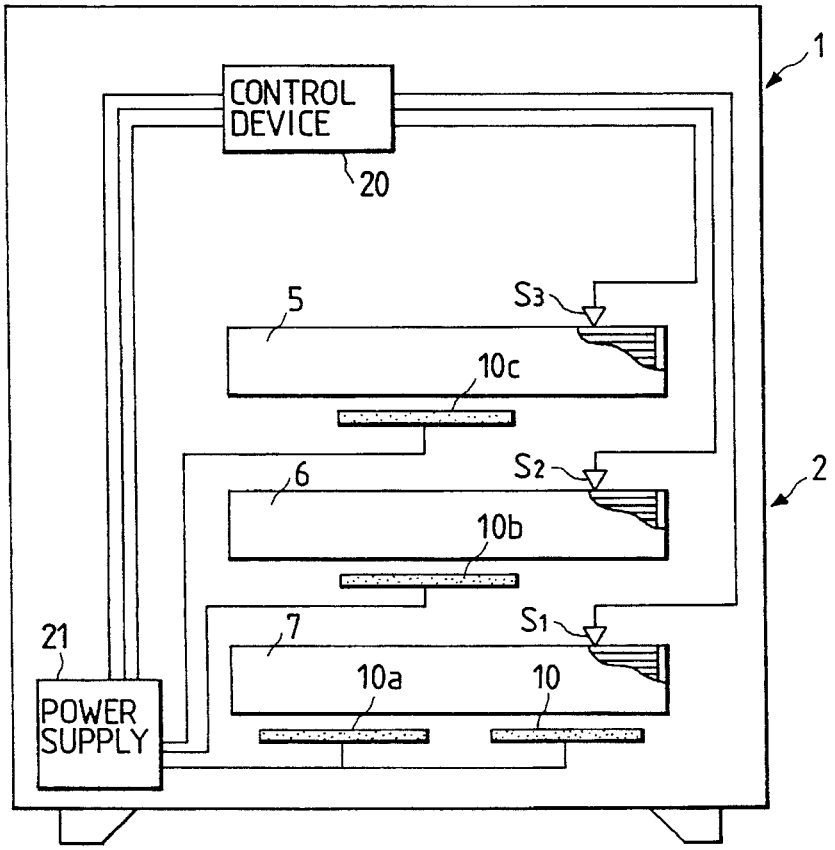
FIG. 4 is a block diagram illustrating still another dehumidifying mechanism of the present invention.

In addition to the dehumidifying unit shown in FIGS. 1 to 3, temperature or humidity sensors S1 to S3 are arranged for the respective paper feeding trays 5 to 7 disposed in the paper feed portion as shown in FIG. 4 to comprehend the moisture content of copying paper accommodated in each tray according to the present invention. Power is supplied from a power supply 21 to individual heating members 10 to 10*c* corresponding to the respective paper feeding trays. Data from the above sensors are input to a control device 20, which then instructs the power supply 21 to supply power to each heating member thereby. The use of such a control means brings the heating action into full play for dehumidifying the copying paper accommodated in the paper feeding trays, thus making easy the operation of dehumidifying the copying paper.

Figure 5:
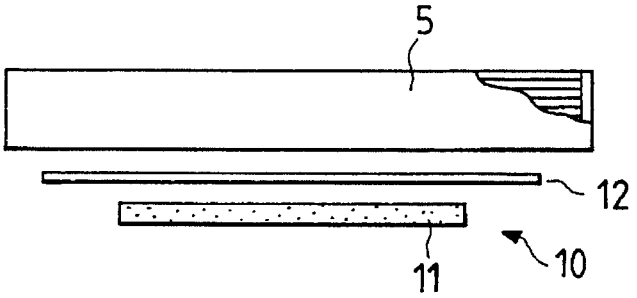
FIG. 5 is a block diagram illustrating a heating member of the present invention.

As the dehumidifying unit according to the present invention is designed to perform the dehumidifying operation through the indirect heating action without directly transmitting heat from the heating element to the paper feeding tray or copying paper itself, a heat reflective plate 12, for example, may be set between a paper feeding tray 5 and a heating element 11 to form a heating member 10 as shown in FIG. 5. In an example of FIG. 5, the heat reflective plate 12 is placed under the bottom plate of the paper feeding tray 5 with the predetermined gap left therebetween and the heating element 11 is placed under the heat reflective plate, so that the heating action resulting from the heat of the heating element is prevented from being directly exerted to the bottom plate of the tray. When the heating element 11 is supplied with power, the heat produced by the heating element is introduced from the side of the tray to the whole paper feed portion by heating action under a convection current of heat, so that the heating action is indirectly exerted to the copying paper accommodated in the tray.

Figure 6:
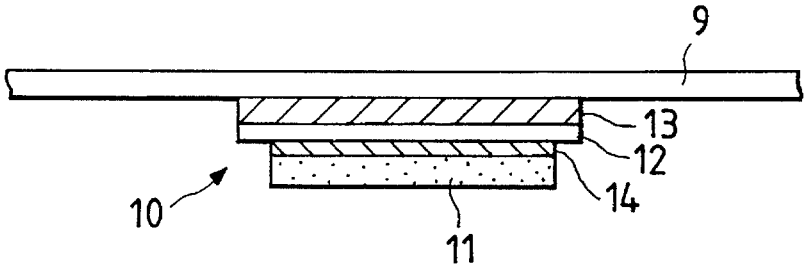
FIG. 6 is a block diagram illustrating another heating member of the present invention.

In an example of FIG. 6, further, a heating member 10 is placed with respect to a frame 9 crossing a paper feed. The heating member 10 includes a heat insulating plate 13 fitted to the frame 9, a heat reflective plate 12 joined to the undersurface of the heat insulating plate 13 and a heating element 11 affixed to the undersurface of the heat reflective plate 12 with an adhesive member 14. A double adhesive tape or the like may be used as the adhesive member 14 and these tapes may also be used for fitting the heat insulating plate to the frame and joining the heating insulating plate 13 and the heat reflective plate 12 together. In this case, the heat reflective plate 12 for use according to the present invention can be a sheet-like heat reflective member such as aluminum foil, for example, and a heat-resistant felt member or any other thin heat-resistant member for use in fixing apparatus may also be used as the heat insulating plate.

Figure 7:
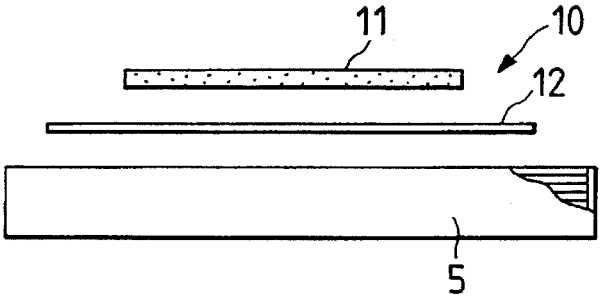
FIG. 7 is a diagram illustrating a case where the heating member is placed above the tray.
Figure 8:
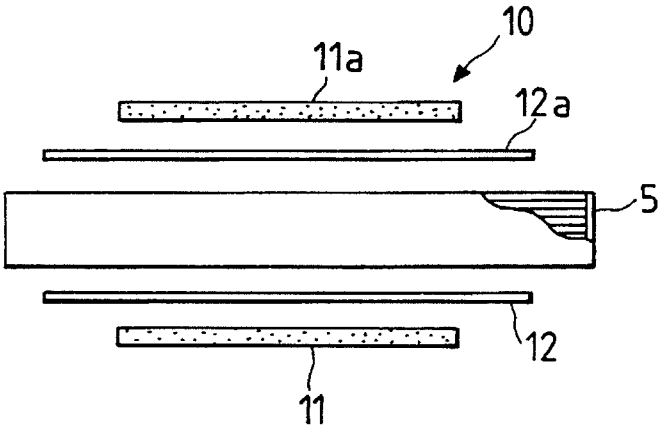
FIG. 8 is a diagram illustrating a case where the heating members are placed above and under the tray, respectively.

In an example of FIG. 7, when a heating member 10 is placed above the paper feeding tray 5, a heat reflective plate 12 is held between a heating element 11 and a paper feeding tray 5 to prevent the heat element from directly heating copying paper. In an example of FIG. 8, moreover, when heat reflective plates 11, 11*a* are placed above and under a paper feeding tray 5, a heat reflective plate 12 is placed between each heat reflective plate and the paper feeding tray 5 so as to prevent the heating elements from directly heating the frame of the tray and copying machine. Accordingly, in the above described examples according to the present invention, only a specific sheet of copying paper or part thereof is kept from being intensely heated by the heating elements even when the heating members are located under the paper feeding tray or between the paper feeding trays according to the present invention. It is possible to exert the dehumidifying action effectively on copying paper by regulating air flowing in the whole paper feed.

As shown in FIGS. 5 to 8, the heating member according to the present invention is placed in between the paper feeding trays, for example, to regulate humidity in the whole paper feed. Moreover, use can be made of the means of fitting the heating element via the heat insulating and heat reflective plates to the bottom plate of the paper feeding tray and the means of affixing the heating member with screws, adhesive members or the like so as to install the heating member. In a case where the heating member is not directly fitted to the paper feeding tray, it may be left in the air between the trays by providing support fittings directed from the frames on both sides of the paper feed portion toward the heating member. Moreover, any other mechanism may be used as a means of arranging the heating members in the paper feed.

Since the paper dehumidifying unit for an image forming apparatus according to the present invention employs a mechanism for regulating air flowing in the paper feed portion without allowing the heat of the heating elements to be directly transmitted to copying paper and the frames of paper feeding trays, the heating action is not exerted locally to copying paper, whereby it is feasible to prevent copying paper from wrinkling or to prevent the edge portion of copying paper from waving, depending on the moisture content of the copying paper. Consequently, the copying paper fed from the paper feed portion is set free from developing image defects and any inconvenience of deteriorating copy quality. Since the heating means in the paper feed portion is not allowed to directly heat the copying paper accommodated in the paper feeding tray according to the present invention, heat emanating from the heating member can be used to heat the interior of the paper feed portion under a convection current of air. Therefore, data deriving from, for example, the temperature or humidity sensor installed in the paper feed portion can be used to dehumidify the copying paper accommodated in the paper feed portion by operating any means out of the plurality of heating means arranged therein.

What is claimed is:

1. A paper dehumidifying unit for an image forming apparatus having a paper feeding device containing multi-stage paper feeding trays and allowing copying paper to be fed from any one of the trays, said paper dehumidifying unit comprising:

heating means placed under at least one of the paper feeding trays and between the other paper feeding trays in said paper feeding device, for heating the inside of the said paper feeding device to a specified temperature;

control means for controlling the temperature of said heating means; and means for preventing the transmission of the heat emanated from said heating means directly to copying paper.

2. A paper dehumidifying unit for an image forming apparatus as claimed in claim 1, further comprising:

detecting means for detecting at least one of temperature and humidity of an inside of at least one of said paper feeding device and said image forming apparatus;

wherein a plurality of heating means disposed in the paper feeding device are individually controlled according to information from said detecting means.

3. A paper dehumidifying unit for an image forming apparatus as claimed in claim 1, wherein said heating means includes a heating element and a heat reflective member held between said heating element and the tray such that the heat emanated from said heating element is not directly transmitted to the copying paper accommodated in the tray.

4. A paper dehumidifying unit for an image forming apparatus as claimed in claim 2, wherein said heating means includes a heating element and a heat reflective member held between said heating element and the tray such that the heat emanated from said heating element is not directly transmitted to the copying paper accommodated in the tray.

5. A paper dehumidifying unit for a paper feeding device comprising:

a paper feeding tray installed in said paper feeding device;

a heat reflective plate affixed to the bottom of said paper feeding tray, and heating means provided beneath said heat reflective plate.

6. A paper dehumidifying unit for a paper feeding device as claimed in claim 4, wherein a heat insulating plate is provided between the bottom of said paper feeding tray and said heat reflective plate.

7. A paper dehumidifying unit for a paper feeding device as claimed in claim 4, wherein said paper feeding device contains a plurality of paper feeding trays vertically arranged at regular intervals, and the heating means is placed between the paper feeding trays and wherein the heat reflective plate is placed under the heating means.

8. A paper dehumidifying unit for an image forming apparatus having a paper feeding device with an interior and with a plurality of multi-stage paper feeding trays, allowing copying paper to be fed from any one of the trays, said paper dehumidifying unit comprising:

heating means for heating the interior of said paper feeding device;

first control means for controlling a heating temperature of said heating means;

means for preventing transmission of the heat from said heating means directly to the copying paper.

9. A paper dehumidifying unit for a paper feeding device as claimed in claim 8, wherein said heating means is arranged under each of said plurality of multi-stage paper feeding trays.

10. A paper dehumidifying unit for a paper feeding device as claimed in claim 9, further comprising;

comprehending means for comprehending a moisture content of copying paper in each tray of said plurality of multi-stage paper feeding trays;

second control means for controlling a heating action of said heating means corresponding to each of said plurality of paper feeding trays based on information from said comprehending means.

11. A paper dehumidifying unit for a paper feeding device as claimed in claim 8, wherein said plurality of paper feeding trays are arranged such that a lowermost paper feeding tray is below any other paper feeding trays and said heating means is positioned under at least the lowermost paper feeding tray of said plurality of multi-stage paper feeding trays.

12. A paper dehumidifying unit for a paper feeding device as claimed in claim 11, further comprising setting means for setting a heating temperature of said heating means based on one of an external humidity of said image forming apparatus and an internal humidity of said paper feeding device.

13. A paper dehumidifying unit for a paper feeding device as claimed in claim 11, further comprising a fan member for convecting an air in said paper feeding device.

14. A paper dehumidifying unit for a paper feeding device as claimed in claim 11, wherein said heating means comprises a heating plate and a heat reflective plate held between said heating element and one of said plurality of paper feeding tray.

15. A paper dehumidifying unit for a paper feeding device as claimed in claim 14, wherein said heating means is positioned above at least the lowermost paper feeding tray of said plurality of multi-stage paper feeding trays.

16. A paper dehumidifying unit for a paper feeding device as claimed in claim 11, wherein said heating means comprises a frame member crossing said paper feeding device, a heat insulating plate, with an undersurface, fitted to said frame member, a heat reflective member, with an undersurface, arranged to the undersurface of said heat insulating plate and a heating element affixed to the undersurface of said heat reflective member.

17. A paper dehumidifying unit for a paper feeding device as claimed in claim 8, wherein said heating means is positioned under at least the lowermost paper feeding tray of said plurality of multi-stage paper feeding trays.

* * * * *